US006769326B2

(12) United States Patent
Bodard

(10) Patent No.: US 6,769,326 B2
(45) Date of Patent: Aug. 3, 2004

(54) DEVICE FOR SHARPENING THE BLADES OF SHARP TOOLS

(75) Inventor: Jean-Pierre Bodard, Tharon Plage (FR)

(73) Assignee: Bobet Materiel, Champagne (FR)

( * ) Notice: Subject to any disclaimer, the term of this patent is extended or adjusted under 35 U.S.C. 154(b) by 127 days.

(21) Appl. No.: 10/150,020

(22) Filed: May 20, 2002

(65) Prior Publication Data

US 2003/0049998 A1 Mar. 13, 2003

(30) Foreign Application Priority Data

May 18, 2001 (FR) ..... 01 06584

(51) Int. Cl.[7] ..... B24B 3/54
(52) U.S. Cl. ..... 76/86; 76/88; 451/486
(58) Field of Search ..... 76/82, 86, 88; 451/486, 540, 553, 555

(56) References Cited

U.S. PATENT DOCUMENTS

| | | | | | |
|---|---|---|---|---|---|
| 1,041,631 | A | * | 10/1912 | Johnson | 451/486 |
| 1,894,579 | A | * | 1/1933 | Blankner | 451/486 |
| 2,124,646 | A | * | 7/1938 | Barsch | 451/486 |
| 4,550,632 | A | * | 11/1985 | Inman | 76/86 |
| 4,934,110 | A | * | 6/1990 | Juranitch | 451/486 |
| 5,040,435 | A | * | 8/1991 | Millman | 76/86 |
| 5,478,272 | A | | 12/1995 | Cozzini et al. | 451/540 |
| 5,655,959 | A | | 8/1997 | Juranitch | 451/486 |

FOREIGN PATENT DOCUMENTS

| | | | |
|---|---|---|---|
| GB | 191266 | | 1/1923 |
| GB | 293785 | * | 3/1928 |
| GB | 517242 | * | 1/1940 |

* cited by examiner

*Primary Examiner*—Hwei-Siu Payer
(74) *Attorney, Agent, or Firm*—Young & Thompson

(57) ABSTRACT

A device for sharpening the blades of sharp tools includes a plate fitted with an opening letting through the tool blade, opposite which opening are provided two sharpening structures in the form of oblong spindles which cross one another. Both these sharpening spindles are hinged at one of their ends on the plate, each on one side of the opening, and they include an elastic recall device for forming a sharpening V mobile under the pressure of the blade to be sharpened. Each sharpening spindle has a U-shaped rod with two parallel or substantially parallel arms which are connected at the bottom of the U and both fee ends of the U include square junctions forming hinging axes which are recessed, free to rotate, in offset engagement orifices provided on an appropriate support interlocked with the plate, in order to obtain elastic recall of the sharpening spindles by a twisting effect.

11 Claims, 3 Drawing Sheets

DEVICE FOR SHARPENING THE BLADES OF SHARP TOOLS

FIELD OF THE INVENTION

This invention concerns a tooling for sharpening the blades of sharp or cutting tools, and in particular knife blades.

BACKGROUND OF THE INVENTION

The blades of sharp tools call for regular maintenance in order to preserve their cutting power.

Such maintenance consists of regular sharpening operations during which the cutting edge is corrected using a grindstone or a suitable machine; between two sharpening operations, the wear of the cutting edge is delayed by sharpening operations using a so-called tool sharpening steel, a diabolo-type whetstone or still a sharpening module fitted with (fixed or hinged) cross spindles.

The type of tool sharpening steel used depends on the degree of wear of the blade. Quite often, the operator uses a <<rough>> sharpening steel to start off, before using a <<smooth>> finishing sharpening steel acting as a burnisher for the edge of the blade.

But the implementation of these tool sharpening steels calls for high level of technical know-how and an experienced hand; consequently, they cannot be used efficiently by anybody.

Diabolo-type sharpening steels and those with fixed spindles are relatively inefficient and are not able to obtain interesting sharpening quality.

The sharpening modules fitted with cross spindles are used generally to burnish the tool blades and it is interesting to see that they can be used in a satisfactory manner even by people without a long experience or high level of technical know-how as far as sharpening is concerned.

Such a device, described in the document U.S. Pat. No. 5,478,272, consists of a plane base wherein is provided a vertical slot intended for the passage of the blade to be sharpened, and fitted with two sharpening spindles crossing one another opposite said slot. Both sharpening spindles, made of steel wire, are generally curved in shape and they are hinged at their upper end on the plane base, by means of rotary buttons associated with recall springs. These spindles form together a sharpening V which is mobile under the pressure of the tool blade to be sharpened; the corresponding mobile V enables to ensure regular or relatively regular processing pressure on the tool blade.

Lower and upper stops limit the pivoting of said spindles between a high position and a low position.

The structure of this type of device is however relatively complex, in particular due to the presence of recall springs integral with the rotary buttons. Moreover, these springs wear out quite rapidly and it is necessary to replace them on a regular basis, which is not always very easy to realize, and which involves important part and labor costs.

SUMMARY OF THE INVENTION

This invention concerns a sharpening device such as the one which has just been described, i.e. with hinged cross spindles, but with simplified structure, hence easier maintenance and cheaper cost price.

Another purpose of this invention is to enhance the guiding of the tool blade to perfect the sharpening quality.

Another purpose still of the invention is to provide in addition to both hinged sharpening spindles acting as a burnisher, a complementary device capable of ensuring enhanced grinding operations of the edge of the tool blade (enhanced operations that are similar to those fulfilled by conventional <<rough>> sharpening steels).

The device according to this invention, for sharpening the blades of sharp tools, is therefore of the type comprising a plate fitted with an opening letting through the tool blade, opposite which opening are provided two sharpening structures in the form of oblong spindles crossing each other, which sharpening spindles are hinged at one of their ends on said plate, each of one side of said opening, and comprise elastic recall means, in order to obtain a mobile sharpening V under the pressure of the blade to be sharpened.

According to this invention, each sharpening spindle consists of a U-shaped rod comprising two parallel or substantially parallel arms connected at the bottom of the U and both free ends of the U comprise square junctions, forming hinging axes which are accommodated and free to rotate in offset engagement orifices, provided on said plate or on an appropriate support interlocked with said plate, in order to obtain an elastic recall of said sharpening spindles by a twisting effect.

Still according to the invention, both sharpening spindles are generally curved in shape delineating an angle in the order of 40° with respect to one another.

Still according to the invention, the plate of the device is fitted with a vertical opening, both sharpening spindles being hinged in the upper section of the supporting plate, on axes perpendicular to the plane of the latter.

According to a preferred embodiment, both sharpening spindles comprise each square junctions oriented in revere direction. In home position, these junctions are advantageously offset from their axes.

The square junctions of the sharpening spindles, which form the hinging axes, may also be extracted easily from their reception, in order to render said spindles removable with a view notably to facilitate their replacement or their cleaning.

According to another interesting particularity, both sharpening spindles are engaged into one another.

According still to another particularity, the sharpening device according to this invention comprises a guiding structure of the tool blade, in the form of two independent plate blades arranged opposite to one another, fixed at their upper end on the plate or on a support interlocked with said plate. Both these blades are spaced from one another in the upper section and they contact one another at their lower end to delineate a self-clamping guiding V, provided just behind both sharpening spindles.

Both these guiding blades are preferably arranged as a dihedron to form a first V flared in the upper section of the opening of the plate, and a second V narrow in its lower section.

Still according to another characteristic, the guiding blades are fitted, in their lower section, with means to grind the edge of the tool blades. These means are advantageously under the form of two single piece tabs each withdrawn from one of the guiding blades and folded in reverse direction with respect to one another to form a grinding V.

According to another particularity, the plate of the sharpening device comprises a single piece tab enabling removable engagement into an appropriate support.

BRIEF DESCRIPTION OF THE DRAWINGS

But the invention will be better illustrated, without being limited in any way, by the following description of a particular embodiment, given only for exemplification purposes and represented on the appended drawings wherein.

DETAILED DESCRIPTION OF THE INVENTION

Figure 1:
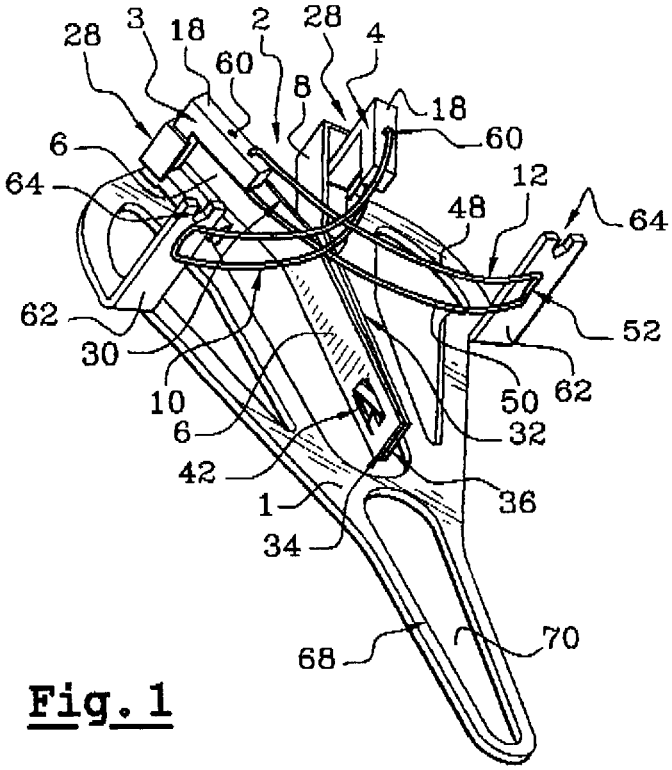
FIG. 1 is a perspective view of a sharpening device according to this invention.

The sharpening device illustrated on FIGS. 1 to 5 consists of a metal plate 1 in the middle zone thereof is provided an opening 2 emerging upwards.

In the upper section of this opening 2, the plate 1 is fitted with two add-on structures 3 and 4 forming supports, on the one hand for a couple of flat blades 6, 8 intended for guiding the blade of the tool to be sharpened, and on the other hand for two sharpening spindles 10, 12 crossing one another just in front of said guiding blades 6, 8.

Figure 8:
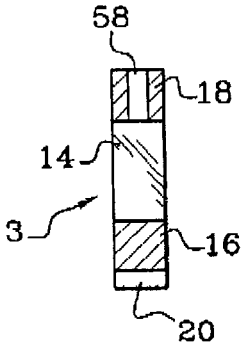
FIG. 8 is a cross sectional view along 8—8 of FIG. 7.
Figure 6:
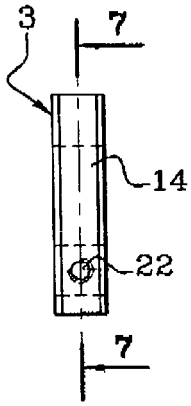
FIG. 6 is a view from beneath of one of the supporting elements of a sharpening spindle, represented individually.
Figure 11:
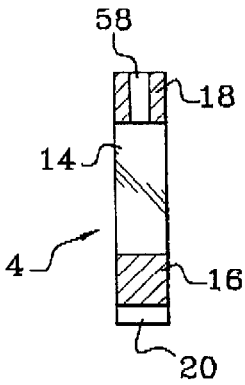
FIG. 11 is a cross sectional view along 11—11 of FIG. 10.
Figure 9:
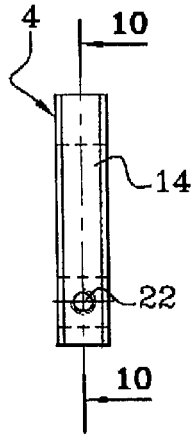
FIG. 9 is a view from beneath of the other supporting element of a sharpening spindle, represented individually.

The support 3 is illustrated individually on FIGS. 6 to 8, and the support 4 on FIGS. 9 to 11; both these supports 3 and 4 have the same general structure, but the support 3 is slightly shorter, in order to enable both sharpening spindles 10, 12 to engage into one another, as seen below.

Each support 3, 4 is generally U-shaped comprising a seat 14, a rear wing 16 and a front wing 18. They extend perpendicular to the plane of the plate 1, protruding to the front, welded to their rear wing 16 on said plate 1 along the rims of the opening 2.

Figure 7:
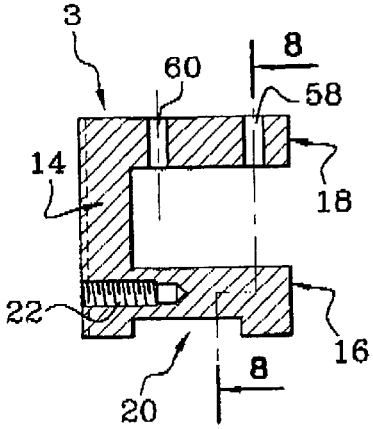
FIG. 7 is a cross sectional view along 7—7 of FIG. 6.
Figure 10:
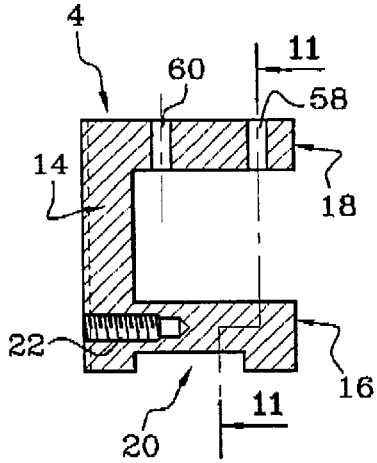
FIG. 10 is a cross sectional view along 10—10 of FIG. 9.

FIGS. 7 and 10 show a scalloping 20 provided in the rear wing 16, which facilitates correct positioning of the supports 3 and 4 on a complementary engagement shape cut in the plate 1, before being interlocked by welding.

Figure 4:
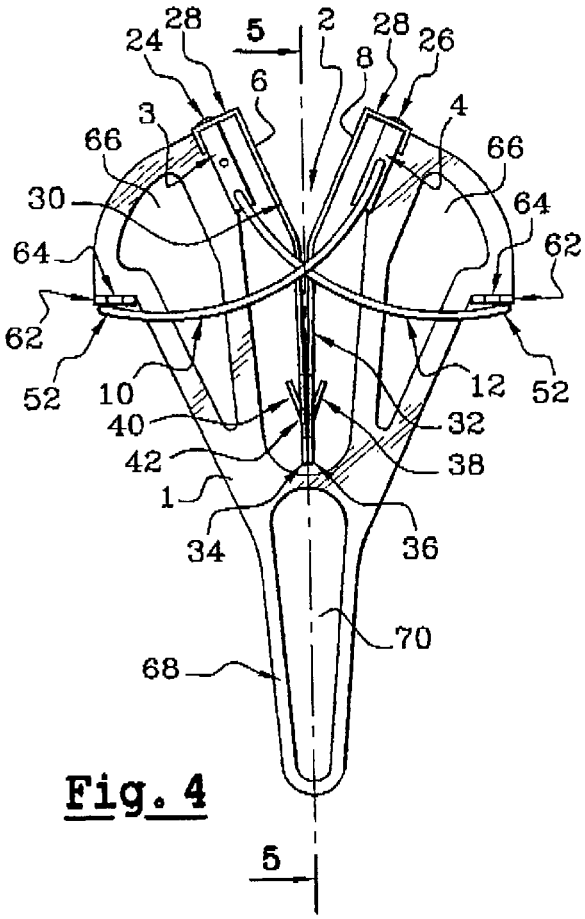
FIG. 4 is a front view of the device illustrated on FIG. 1.

The seat 14 of the supports 3 and 4 comprises a tapered orifice 22 which enables removable fastening of the flat blades 6 and 8 by means of a screw 24, 26 (FIG. 4).

Both flat blades 6 and 8 are made for instance of chromium plated stainless steel; they are laid out opposite to one another and they extend perpendicular to the plane of the plate 1. These blades 6, 8 comprise each an L-shaped end junction 28 which enables to fasten them on the supports 3 and 4 by means of the screws 24, 26; from this L-shaped junction 28, both blades 6 and 8 take each the shape of a dihedral to form together a first flared V 30 in the upper section of the opening 2, followed by a second narrow V 32, in the lower section of said opening.

The lower rims 34 and 36 of both blades 6 and 8 contact one another to form a self-clamping guiding system.

Just above their lower rim 34 and 36, both blades 6 and 8 comprise offset internal cut-outs 38 and 40 (FIG. 2) which form of the single piece tabs folded in reverse direction with respect to one another to constitute a V 42 enabling to grind the edge of the tool blade, in a perfect alignment.

The angle formed by both tabs 38 and 40 is in the order of 40°.

Each single piece tab 38, 40 is associated with a lateral opening enabling the counter tab to engage.

Both sharpening spindles 10 and 12 are made of metal wire, for instance of chromium plated stainless steel wire. They consist of a U-shaped rod, comprising two parallel arms 48, 50, integral with one of their ends 52 and thereof the free ends comprise single piece square junctions 54, 56, illustrated as dotted lines on FIG. 5, shrink-fitted in appropriate orifices 58, 60 provided in the front wing 18 of the supports 3 and 4.

This engagement of the junctions 54 and 56 in the orifices 58 and 60 authorizes the hinging of the spindles 10 and 12 on their respective support 3, 4, around axes perpendicular to the supporting plate 1.

The orifices 58 and 60 extend perpendicular to the plane of the plate 1 and they traverse the front wing 18 of the supports 3 and 4.

Both orifices 58 and 60 are offset to obtain an elastic recall system of the spindles 10 and 12 by a twisting effect of both parallel arms 48 and 50. The positioning of the junctions 54, 56, and that of both reception orifices 58, 60 is suited to obtain the elastic recall characteristics required.

In home position, both arms 48 and 50 of the spindles 10 and 12 are parallel, and one of these arms is slightly longer than the other to offset both junctions 54 and 56 in order to enable them to engage in the orifices 58, 60.

These junctions 54, 56 are oriented in reverse direction with respect to one another so that both parallel arms 48, 50 of the spindles 10, 12 can be positioned on either side of the front wings 18 of the supports 3 and 4, such positioning being possible thanks to the elasticity of the end link 52 of said spindles. The junctions 54 and 56 are simply shrink-fitted in the orifices 58 and 60, free to rotate and removable.

Figure 3:
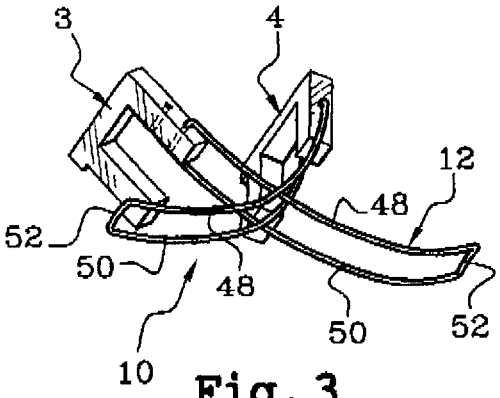
FIG. 3 is a perspective enlarged view of both sharpening spindles mounted on their support.
Figure 2:
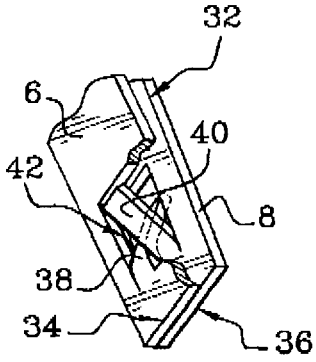
FIG. 2 is a perspective enlarged view of the grinding V at the lower end of the guiding blades.
Figure 5:
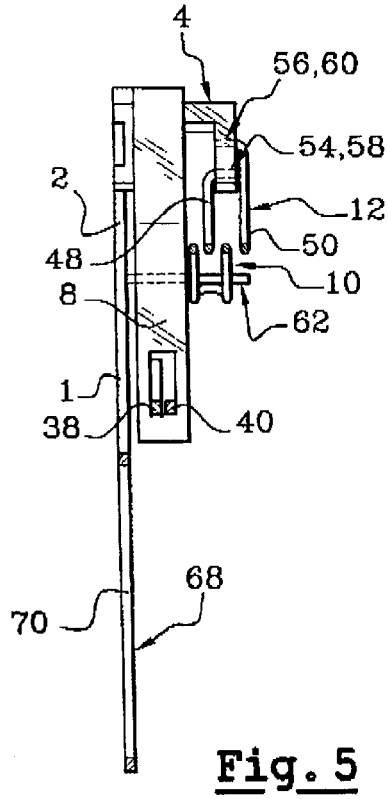
FIG. 5 is a cross sectional view along 5—5 of FIG. 4.

Both sharpening spindles 10 and 12 are mounted and engaged into one another as illustrated on FIGS. 1, 3 and 5 to optimize the sharpening operations, and also to limit the square requirements of the device. This engagement is here realized thanks to a slight difference in length of the supports 3 and 4.

FIGS. 1, 3 and 5 show the general curved shape of both spindles 10 and 12, which enables to preserve between them an angle in the order of 40°, regardless of the penetration depth of the tool blade.

In home position, both sharpening spindles 10 and 12 are in high position, their end being blocked by stopping structures 62 arranged on the sides of the plate 1. These stops 62 can also be single pieces, by folding the lateral sections of the plate 1; they may also consist of independent add-on elements fastened by any appropriate means.

At the ends of the stops 62, one notices the presence of a small cut-out 64 (FIGS. 1 and 4) structured to form a control gauge enabling the operator to check the wear of the tip of his knife.

In home position, it can be noticed that both sharpening spindles 10 and 12 cross one another just below the transition level between the flared V 30 and the narrow V 32 of the guiding blades 6 and 8.

The supporting plate 1 is generally triangular in shape; it may comprise internal openings 66 on either side of the emerging opening 2, which enable to make it lighter.

In its lower section, the plate 1 is fitted with a single piece tab 68 which enables removable engagement of the sharpening device in an appropriate support, fixed to the working station. The device can then be removed easily from its support, in particular for cleaning or disinfection purposes.

An internal cut-out 70 provided in the single piece tab 68 still enables to make the device lighter.

Figure 12:
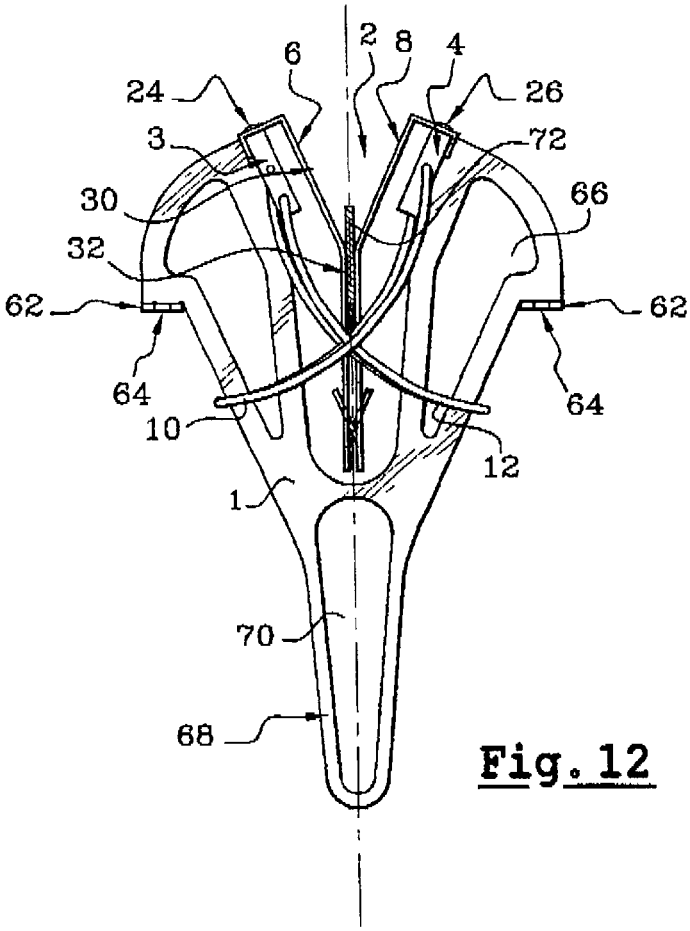
FIG. 12 is a front view of the sharpening device illustrated on FIG. 1, with a knife blade positioned between the guiding blades.

As shown on FIG. 12, once the device has been positioned vertically on its support (not represented), the operator places the tool blade 72 that he wants to sharpen between both blades 6 and 8 which form a self-clamping guiding. If he desires to use the grinding V 42 formed by both single piece tabs 38 and 40, he applies a vertical pressure on the tool, sufficient for its blade to reach said V 42 while spreading both spindles 10, 12 apart; the operator can then apply suited back and forth movements to <<grind>> the edge of the tool blade, in a similar fashion or close to conventional machining by a <<rough>> sharpening steel.

The tool blade is then guided by the self-clamping V 32 of the guiding blades 6, 8 which ensures a perfect working angle.

Both sharpening spindles 10 and 12 are then used for finishing the sharpening operation, i.e. to <<burnish>> or smooth the tool blade, as can be done conventionally with a <<smooth>> sharpening steel.

The operator then moves the tool blade back and forth on both sharpening spindles 10, 12, while applying just a pressure sufficient not to reach the grinding V 42.

Both sharpening spindles 10 and 12 are similar to mobile arc-shaped twisting bars and they enable to preserve between themselves, regardless of the penetration depth of the tool blade in the narrow V 32, the correct leading angle which enables to optimize the machining on the edge of the blade.

The downward motion of the tool blade is limited by the presence of the grinding V 42 and it is hence not necessary to provide lower stopping structures for both sharpening spindles 10 and 12. All things considered, both spindles 10 and 12, engaged into one another, cannot come apart from one another in the lower section.

Both sharpening spindles 10 and 12 comprise intrinsically their own elastic recall means, which simplifies the structure of the device. Moreover, both these spindles can be disassembled from and put back on their support very easily, in particular for replacement operations in case of damage, or simply for cleaning purposes.

The device according to this invention has a relatively straightforward overall structure and it is quite complete since it provides two associated assemblies which enable to machine the edge of the tool blades in a different fashion.

The embodiment which has just been described is made integrally of metal. Obviously certain part, and notably the plate 1 as well as the add-on supporting structures 3 and 4 could be made of moulded plastic material; in the latter case, the fastening of the supporting structures 3 and 4 on the plate made of plastic material can be obtained by suitable screws.

What is claimed is:

1. A device for sharpening the blades of sharp tools, comprising:

a plate fitted with an opening letting through the tool blade;

two oblong sharpening spindles that cross each other, and provided opposite said opening;

said sharpening spindles being hinged at one of their ends on said plate, each on one side of said opening, and comprising elastic recall means, in order to obtain a sharpening V mobile under the pressure of the blade to be sharpened;

each sharpening spindle comprising a U-shaped rod having two parallel or substantially parallel arms connected at the bottom of the U; and both free ends of the U comprising square junctions, forming hinged axes which are recessed, free to rotate in offset engagement orifices, provided on said plate or on an appropriate support interlocked with said plate, in order to obtain an elastic recall of said sharpening spindles by a twisting effect.

2. The device according to claim 1, wherein the two sharpening spindles are generally of curved shape forming permanently between themselves an angle in the order of 40°.

3. The device according to claim 1, wherein the opening is a vertical opening, both sharpening spindles being hinged in an upper section of said plate, on axes perpendicular to the plane of this latter.

4. The device according to claim 1, wherein each of said square junctions is oriented in reverse direction.

5. The device according to claim 1, wherein the junctions are offset in home position.

6. The device according to claim 1, wherein the two sharpening spindles are engaged into one another.

7. The device according to claim 1, further comprising a guiding structure for the tool blade, in the form of two independent blade plates laid out opposite to one another, fixed at their upper ends on the plate, or on the support interlocked with said plate, spaced apart from one another at that level, and which contact one another at their lower ends; said blade plates delineating a self-clamping guiding V just behind both sharpening spindles.

8. The device according to claim 7, wherein the blade plates comprise guiding blades laid out as a dihedral to form a first flared V in the upper section of the opening of the plate, and a second narrow V, in the lower section of said opening.

9. The device according to claim 7, wherein the blade plates comprise guiding blades fitted in a lower section, with means to grind the edge of the tool blades.

10. The device according to claim 9, wherein the means to grind the edge of the tool blades comprise two single piece tabs each withdrawn from one of the guiding blades and folded in reverse direction with respect to one another to form a grinding V.

11. The device according to claim 1, wherein the plate is fitted with a single piece tab.

* * * * *